US008708315B2

(12) United States Patent
Wilcox

(10) Patent No.: US 8,708,315 B2
(45) Date of Patent: Apr. 29, 2014

(54) ELECTRIC MINING SHOVEL HOIST ROPE IMPACT-REDUCTION BOX

(75) Inventor: Craig A. Wilcox, Salmon, ID (US)

(73) Assignee: Premier Technology, Inc., Blackfoot, ID (US)

( * ) Notice: Subject to any disclaimer, the term of this patent is extended or adjusted under 35 U.S.C. 154(b) by 533 days.

(21) Appl. No.: 12/993,584

(22) PCT Filed: May 20, 2009

(86) PCT No.: PCT/US2009/044718
§ 371 (c)(1),
(2), (4) Date: Feb. 3, 2011

(87) PCT Pub. No.: WO2009/143276
PCT Pub. Date: Nov. 26, 2009

(65) Prior Publication Data

US 2011/0180771 A1 Jul. 28, 2011

Related U.S. Application Data

(60) Provisional application No. 61/054,555, filed on May 20, 2008.

(51) Int. Cl.
*B66D 3/08* (2006.01)

(52) U.S. Cl.
USPC ..... 254/396; 254/393; 254/394; 254/395; 254/383

(58) Field of Classification Search
USPC ..... 254/392, 325–327, 405, 334, 335, 336, 254/323, 383, 393, 394, 395, 396, 338; 242/615.2, 615.3
See application file for complete search history.

(56) References Cited

U.S. PATENT DOCUMENTS

| | | | | |
|---|---|---|---|---|
| 1,594,566 | A | 8/1926 | Scott | |
| 5,010,933 | A * | 4/1991 | Doyle | 144/336 |
| 5,050,901 | A * | 9/1991 | Zhao | 280/474 |
| 5,573,226 | A * | 11/1996 | Smith | 254/395 |
| 5,839,213 | A * | 11/1998 | Abbott et al. | 37/443 |
| 2012/0137804 | A1 * | 6/2012 | Sayer | 74/96 |

FOREIGN PATENT DOCUMENTS

| | | |
|---|---|---|
| FR | 1038252 A | 9/1953 |
| GB | 1202090 A | 8/1970 |

OTHER PUBLICATIONS

Machine translation of Hillairet (FR 1038252 A) associated with IDS of Nov. 19, 2010.*
International Search Report for International Application No. PCT/US2009/044718 mailed Aug. 13, 2010, 3 pages.

(Continued)

*Primary Examiner* — Michael Mansen
*Assistant Examiner* — Nathaniel Adams
(74) *Attorney, Agent, or Firm* — TraskBritt, P.C.

(57) ABSTRACT

Disclosed is an impact-reduction box through which the hoisting ropes of a mining shovel or other machine pass. The impact-reduction box includes a roller frame subassembly and spring box subassemblies attached thereto on either side. The impact-reduction box is configured so that when the hoisting cables impact the box during undesirable whipping, the roller frame subassembly will move in reaction while the spring box subassemblies will remain essentially motionless. The mining shovel will feel less of the impact of the jolting hoisting rope, and the rope will not suffer the wear and tear of frequent slapping against the machine such that the rope will be less likely to completely break.

18 Claims, 14 Drawing Sheets

(56) References Cited

OTHER PUBLICATIONS

International Written Opinion for International Application No. PCT/US2009/044718 dated Aug. 13, 2010, 6 pages.

International Preliminary Report on Patentability and Written Opinion for International Application No. PCT/US2009/044718 dated Nov. 10, pages.

* cited by examiner

ELECTRIC MINING SHOVEL HOIST ROPE IMPACT-REDUCTION BOX

CROSS-REFERENCE TO RELATED APPLICATIONS

This is a national phase entry under 35 U.S.C. §371 of International Patent Application PCT/US2009/044718, filed May 20, 2009, published in English as International Patent Publication WO 2009/143276 A2 on Nov. 26, 2009, which claims the benefit under Article 8 of the Patent Cooperation Treaty to U.S. Provisional Patent Application Ser. No. 61/054,555, filed May 20, 2008, the entire disclosure of each of which is hereby incorporated herein by this reference.

TECHNICAL FIELD

The invention relates generally to an apparatus for reducing the impact felt on a machine by cables moving undesirably, such as in a whipping or slapping motion, and for reducing the wear and tear on the cables and, more particularly, to an apparatus for reducing the impact felt by slapping hoisting ropes on an electric mining shovel and for reducing the wear and tear on the hoisting ropes.

BACKGROUND ART

Electric mining shovels are useful for digging up, hoisting, and transporting large volumes of earth or other material. Generally, an electric mining shovel includes a dipper that is operatively connected to a housing and is controlled by an operator. More particularly, the dipper is attached to an arm, known in the industry as "the stick." The stick is pivotally attached to the boom, which is attached to the housing. Hoisting cables attach to the dipper (also known as "the bucket") and pass through a pulley at the end of the boom and then back into the housing where the hoisting cables or ropes are wound or unwound around a drum so as to hoist or lower the dipper. Near the drum, typically on both sides of the drum, are gantry legs that extend out of the top of the housing and are used to help anchor the boom.

In the extension between the drum and the end of the boom, the hoisting cables or ropes pass through the housing via a window. Typically, the window is only five or six feet by two feet in dimension. As the hoisting cables or ropes aid in hoisting or lowering the dipper once it has dug up an amount of earth, the dipper will occasionally jolt up or down. This jolt of the dipper in turn whips, slaps, or otherwise undesirably moves the hoisting ropes or cables, as the case may be. In such case, the hoisting ropes or cables slap against the window opening in the housing. Over time, the slapping of the cables on the window opening wears out the cable, which can then snap or break completely under the strain on the cable during operation of the shovel. In such case, the only option is to cease operation of the mining shovel until the machine can be repaired. This costs otherwise-valuable time while the shovel is inoperable, and repair and replacement costs are incurred.

DISCLOSURE OF INVENTION

Embodiments of the present impact-reduction assembly provide for a simple assembly that is mountable to an electric mining shovel or other machine and is situated so that hoisting ropes or cables pass therethrough as the hoisting ropes or cables extend from the drum, through the housing window, and out to the end of the boom. More particularly, the present impact-reduction assembly is mounted to either the gantry legs of the shovel, just after the hoisting cable comes off of the drum, or to the housing itself between the gantry legs.

In the event that the hoisting ropes or cables are whipped so that they undesirably move, they come into contact with rollers included in a roller frame subassembly, which is configured to move relative to portions of at least one pair of spring box subassemblies while those portions of the spring box subassemblies remain essentially motionless relative to the machine, e.g., mining shovel, to which they are mounted. Thus, when the hoisting rope or cable moves unexpectedly, rather than slap on the window opening of the housing or on other parts of the mining shovel, the rope or cable will impact only the roller frame subassembly of the impact-reduction box. The roller frame subassembly will move against springs or other compressors that will act against the frame subassembly to re-steady it while the rest of the impact-reduction assembly remains essentially motionless. This reduces the wear and tear on the hoisting rope or cable, reduces the risk of the hoisting rope or cable breaking, extends the life of the hoisting rope or cable, and further reduces the impact on the rest of the mining shovel or other machine from the slapping cables.

MODES FOR CARRYING OUT THE INVENTION

Figure 1:
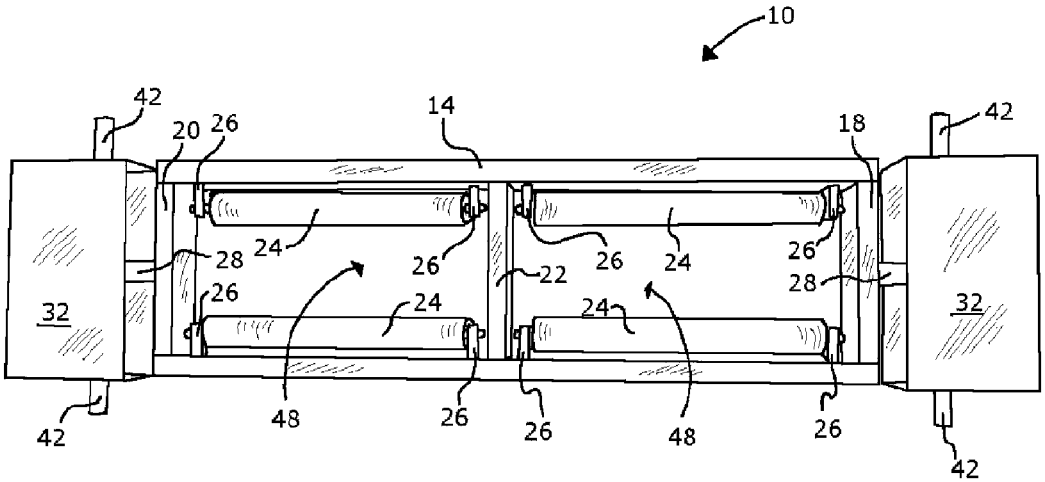
FIG. 1 is a perspective, elevation view of the impact-reduction assembly according to a first embodiment.
Figure 2A:
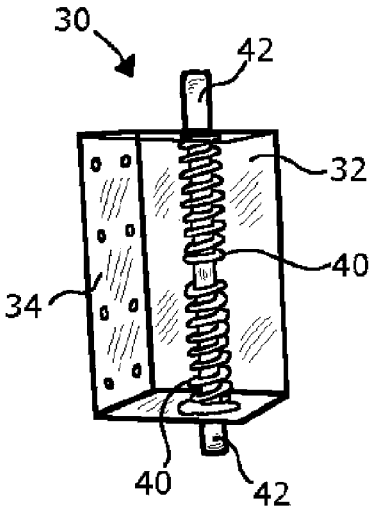
FIG. 2*a* is a perspective, elevation view of a left spring box subassembly of the impact-reduction assembly according to the first embodiment with the front spring box side removed so as to be able to see the inside of the spring box subassembly.
Figure 2B:
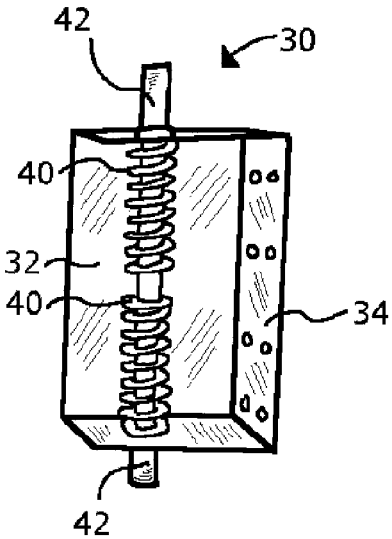
FIG. 2*b* is a perspective, elevation view of a right spring box subassembly of the impact-reduction assembly according to the first embodiment with the front spring box side removed so as to be able to see the inside of the spring box subassembly.

While the impact-reduction box is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined herein.

In the following description and in the figures, like elements are identified with like reference numerals. The use of "or" indicates a non-exclusive alternative without limitation unless otherwise noted. The use of "including" means "including, but not limited to," unless otherwise noted.

A first preferred embodiment of the impact-reduction box is shown in FIGS. 1 through 18. A second preferred embodiment of the impact-reduction box is shown in FIGS. 19 through 27. A third preferred embodiment of the impact-reduction box is shown in FIGS. 28 and 29. According to these embodiments, as shown, the impact-reduction assembly 10 includes a roller frame subassembly 12 and a number of spring box subassemblies 30.

The roller frame subassembly 12 includes a roller frame made up of a frame top side 14, a frame bottom side 16, a frame right side 18, and a frame left side 20. As shown in FIG. 1, it is preferred that the roller frame subassembly 12 further includes a frame middle support 22. The frame top side 14 connects to the frame right side 18, the frame left side 20, and the frame middle support 22 such that, preferably, the frame top side 14 is essentially perpendicular to the frame right side 18, the frame left side 20, and the frame middle support 22. The frame bottom side 16 also connects to the frame right side 18, the frame left side 20, and the frame middle support 22 such that, preferably, the frame bottom side 16 is essentially perpendicular to the frame right side 18, the frame left side 20, and the frame middle support 22. As such, preferably, the frame top side 14 is essentially parallel to the frame bottom side 16. It is preferred that the frame left side 20, frame right side 18, and frame middle support 22 are made of two-by-ten box tubing. It is also preferred that the frame top side 14 and frame bottom side 16 are made of one-and-a-half-by-ten channel iron.

Figure 23:
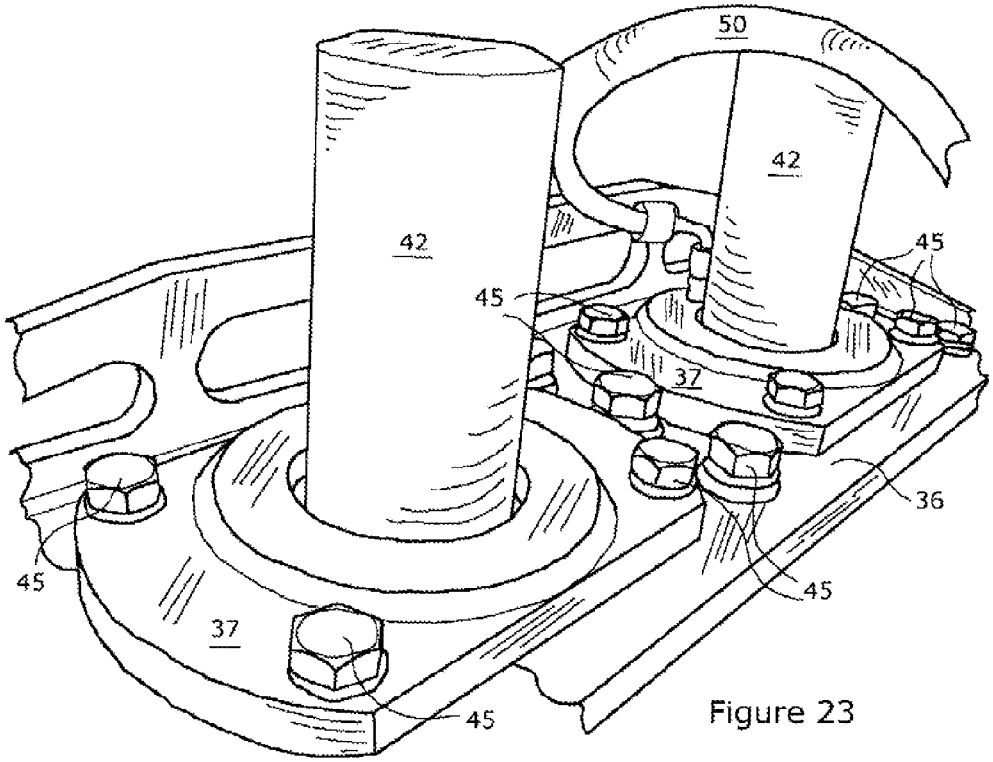
FIG. 23 is a top side, partial, perspective view of the left-most spring box subassembly of the impact-reduction assembly according to the second embodiment.
Figure 24:
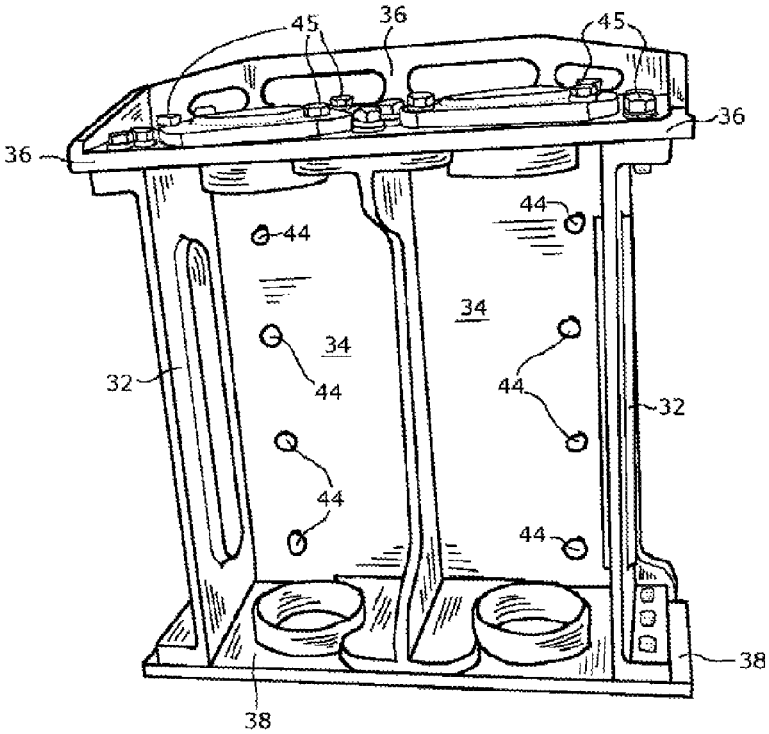
FIG. 24 is a perspective, elevation view of a spring box subassembly of the impact-reduction assembly according to the second embodiment.
Figure 25:
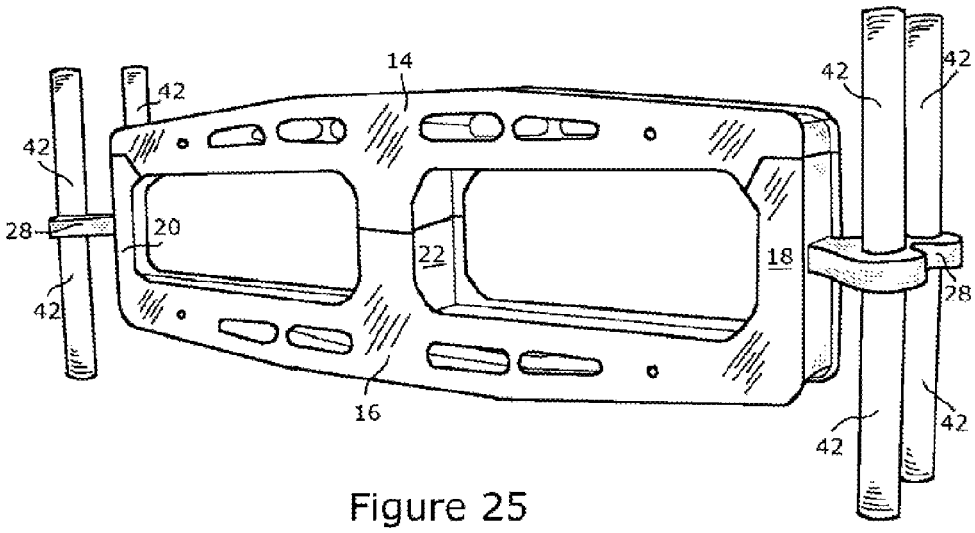
FIG. 25 is front and right side, perspective view of a roller frame subassembly of the impact-reduction assembly according to the second embodiment, without a plurality of rollers in place.
Figure 26:
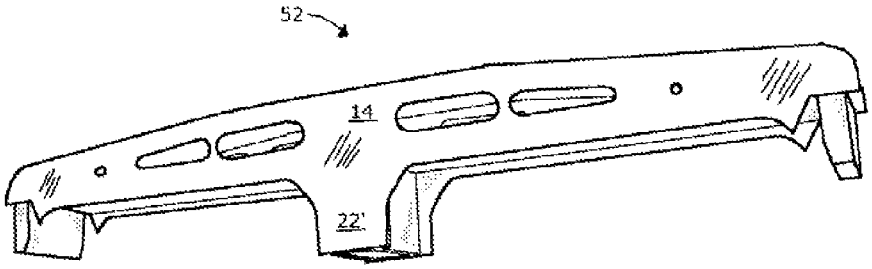
FIG. 26 is a front side, perspective view of an upper frame segment of a roller frame subassembly of the impact-reduction assembly according to the second embodiment.
Figure 27:
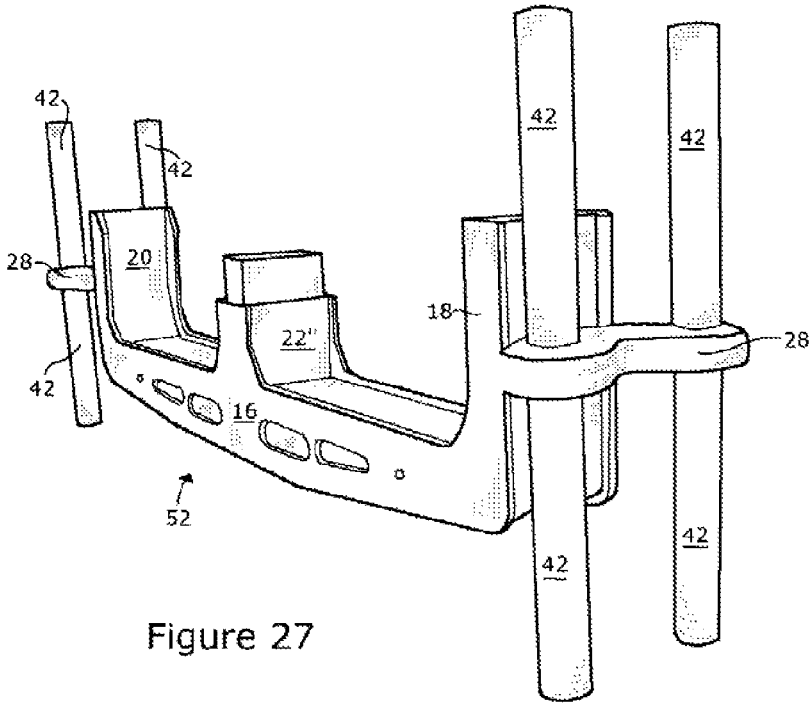
FIG. 27 is a front and right side, perspective view of a lower frame segment of a roller frame subassembly of the impact-reduction assembly according to the second embodiment.
Figure 28:
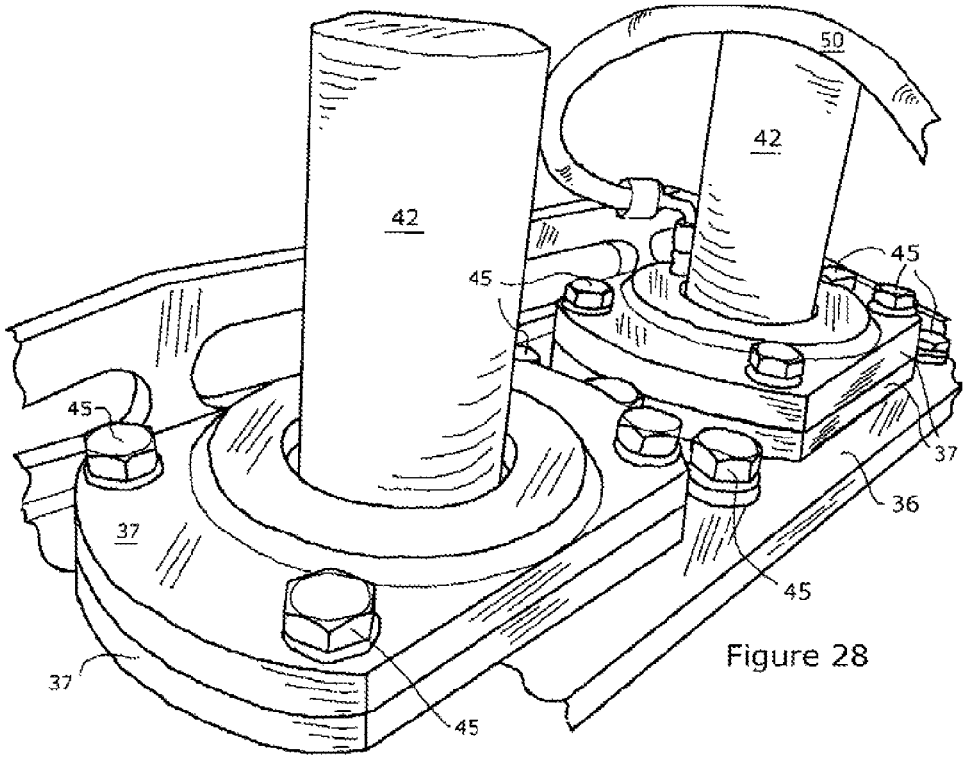
FIG. 28 is a top side, partial, perspective view of the left-most spring box subassembly of the impact-reduction assembly according to a third embodiment.
Figure 29:
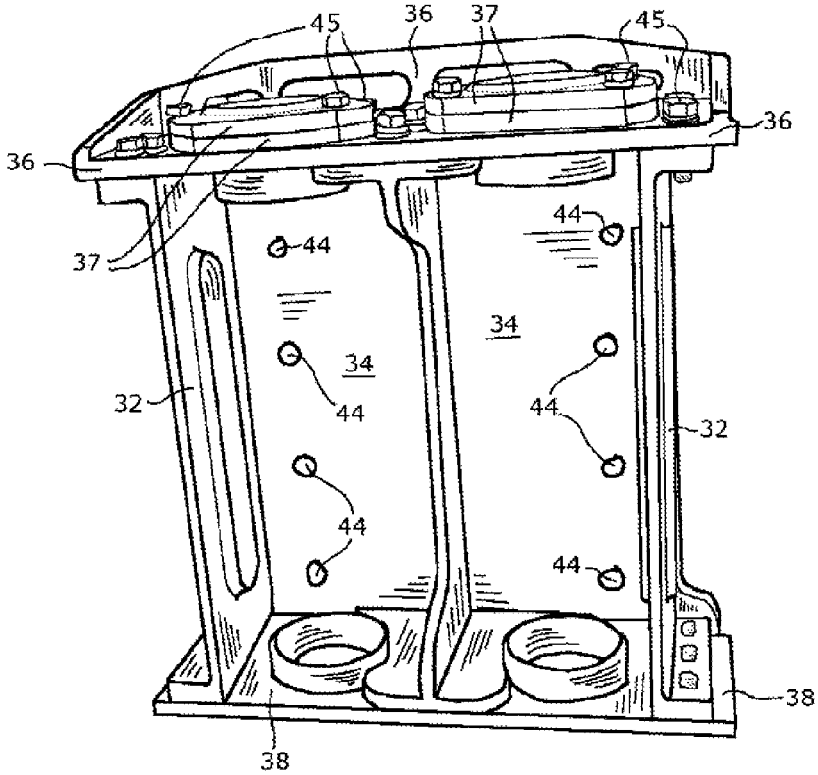
FIG. 29 is a perspective, elevation view of a spring box subassembly of the impact-reduction assembly according to the third embodiment.

According to the second and third preferred embodiments, shown in FIGS. 19 through 29, the roller frame subassembly 12 is segmented into an upper frame segment 52 (FIG. 26) and lower frame segment 54 (FIG. 27). The upper frame segment 52 includes the frame top side 14 and an upper frame middle support 22'. The lower frame segment 54 includes the frame bottom side 16, frame right side 18, frame left side 20, and lower frame middle support 22". In this way, the roller frame subassembly 12 may be assembled by interconnecting only the upper frame segment 52 with the lower frame segment 54, as shown in FIG. 25.

The roller frame subassembly 12 further includes a number of rollers 24. As shown in the figures, it is preferred that the roller frame subassembly 12 include at least four rollers 24. These are preferably nylon rollers having diameters in the range of three to four inches. According to the preferred embodiments, two of the rollers 24 are affixed to the frame top side 14 and two are affixed to the frame bottom side 16 via pillow block bearings 26. Thus, the rollers 24 are arranged to be essentially parallel to the frame top side 14 and the frame bottom side 16.

In this configuration, the roller frame subassembly 12 defines at least one cable pass-through space 48 between the various rollers 24 so that a hoisting cable or cables can be passed through the roller frame subassembly 12. According to the first, second, and third embodiments shown in the figures, the roller frame subassembly 12 defines two cable pass-through spaces 48. More specifically, according to the first preferred embodiment, the frame top side 14, frame left side 20, frame bottom side 16, and frame middle support 22 define a left cable pass-through space 48, while the frame top side 14, frame right side 20, frame bottom side 16, and frame middle support 22 define a right cable pass-through space 48. According to the second and third preferred embodiments, the frame top side 14, frame left side 20, frame bottom side 16, lower frame middle support 22", and upper frame middle support 22' define a left cable pass-through space 48, while the frame top side 14, frame right side 20, frame bottom side 16, lower frame middle support 22", and upper frame middle support 22' define a right cable pass-through space 48. Thus, one or more hoisting cables may be passed through the roller frame subassembly 12 on either or both of the sides of the frame middle support 22 (or interconnected lower frame middle support 22" and upper frame middle support 22') of the roller frame subassembly 12.

Attached to both the frame right side 18 and the frame left side 20 are one of a number of roller frame support blocks 28. Preferably, a pair of roller frame support blocks 28 are used, one connected to the frame right side 18 and one connected to the frame left side 20. Also, preferably, the roller frame support blocks 28 are welded to the respective frame right side 18 and frame left side 20 at essentially a mid-point in the height of the frame right side 18 and frame left side 20. Attached to each roller frame support block 28 is at least one spring support rod 42. According to the first preferred embodiment, one spring support rod 42 is attached to each roller frame support block 28. According to the second and third preferred embodiments, two spring support rods 42 are attached to each roller frame support block 28. Preferably, each spring support rod 42 is aligned perpendicular to the roller frame support blocks 28 and parallel to the other spring support rods 42. Preferably, the spring support rods 42 are made of roll steel with a diameter of approximately two inches. It is preferred that the spring support rods 42 be welded to their respective roller frame support block 28 so that the roller frame support block 28 intersects the spring support rod 42 at approximately a mid-point on the spring support rod 42. In other embodiments, the roller frame support blocks 28 each define a rod insertion hole into which the spring support rod 42 may be inserted and thereafter welded to the roller frame support block 28. In other embodiments, the roller frame support block 28 is connected to the spring support rod 42, but not welded thereto, so that the spring support rod 42 may move relative to the roller frame support block 28.

Figure 4:
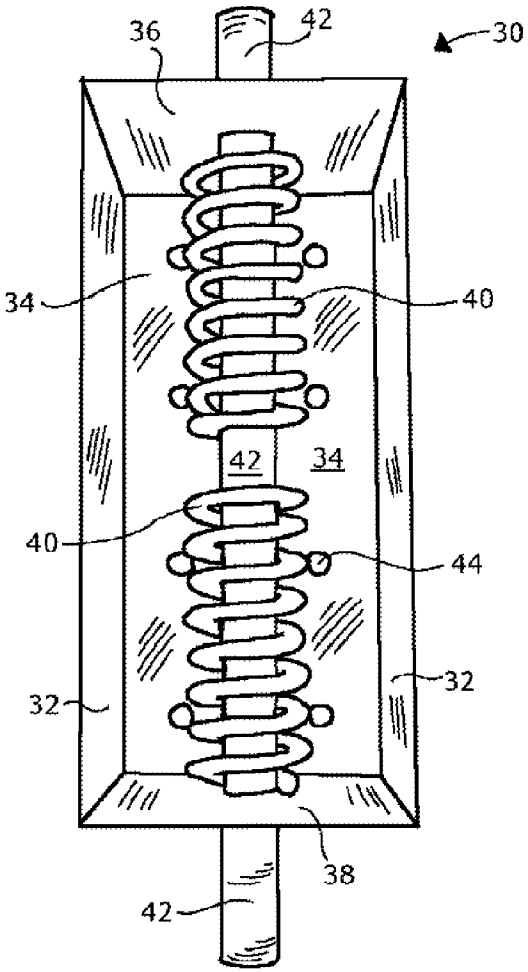
FIG. 4 is side elevation view of the open side of one of the spring box subassemblies of the impact-reduction assembly according to the first embodiment without a roller frame support block attached.
Figure 3:
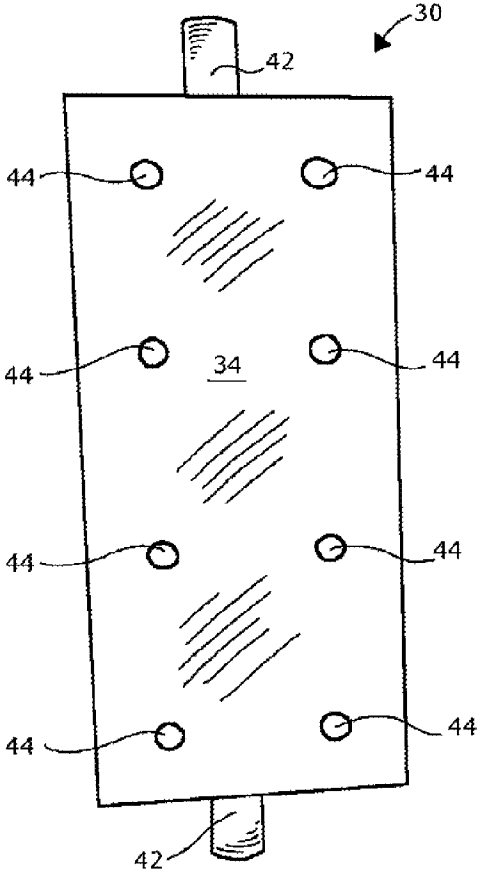
FIG. 3 is a side elevation view of the spring box mounting side of one of the spring box subassemblies of the impact-reduction assembly according to the first embodiment.
Figure 6:
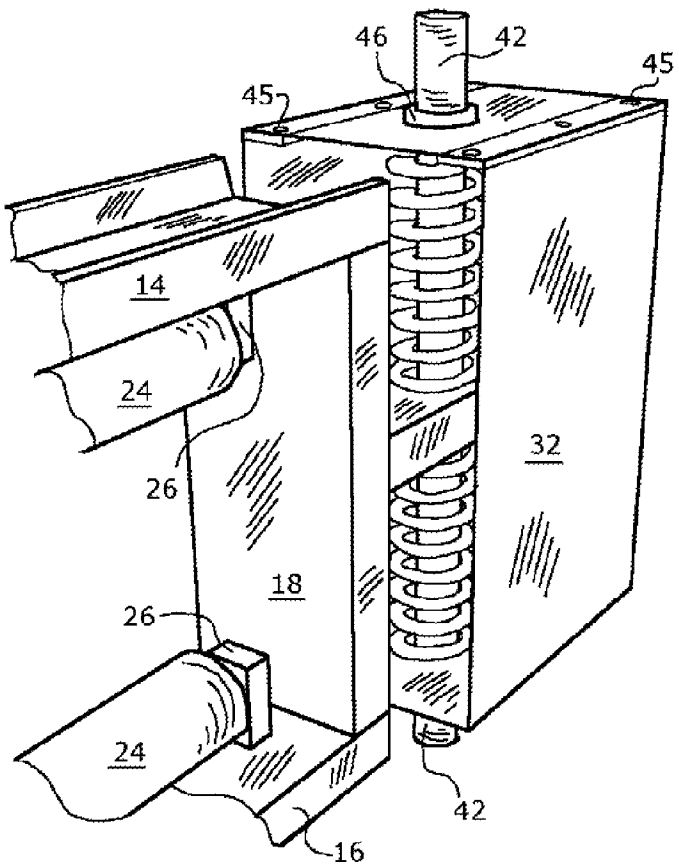
FIG. 6 is a perspective, elevation view of the front and top of the spring box subassembly and partial view of the right-most portions of the roller frame subassembly of the impact-reduction assembly according to the first embodiment.
Figure 5:
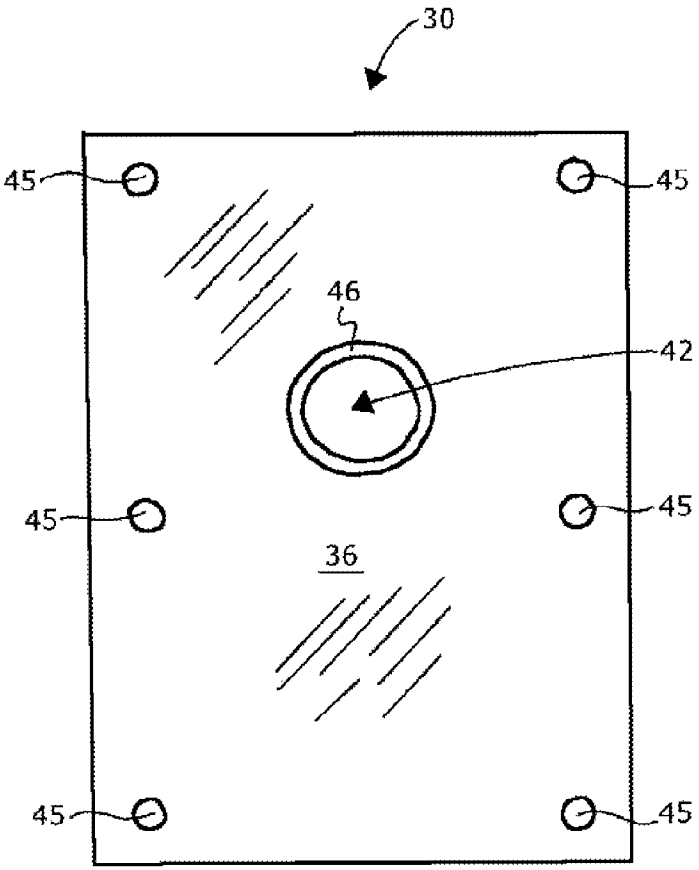
FIG. 5 is a top view of the spring box subassembly of the impact-reduction assembly according to the first embodiment.
Figure 7:
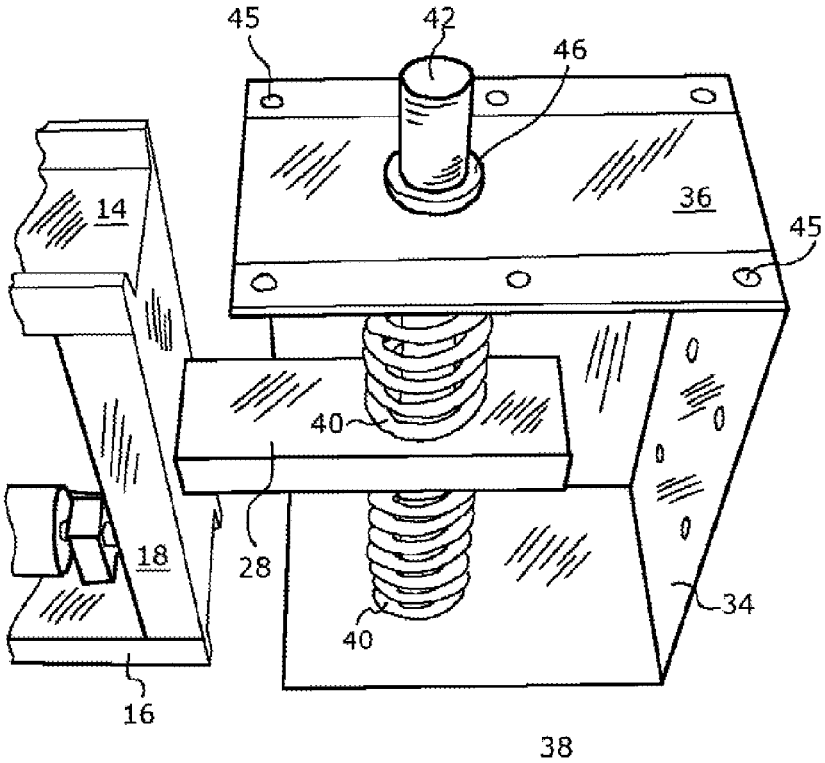
FIG. 7 is a perspective view from the top and front of the spring box subassembly and partial view of the right-most portions of the roller frame subassembly of the impact-reduction assembly according to the first embodiment with the front spring box side removed.
Figure 8:
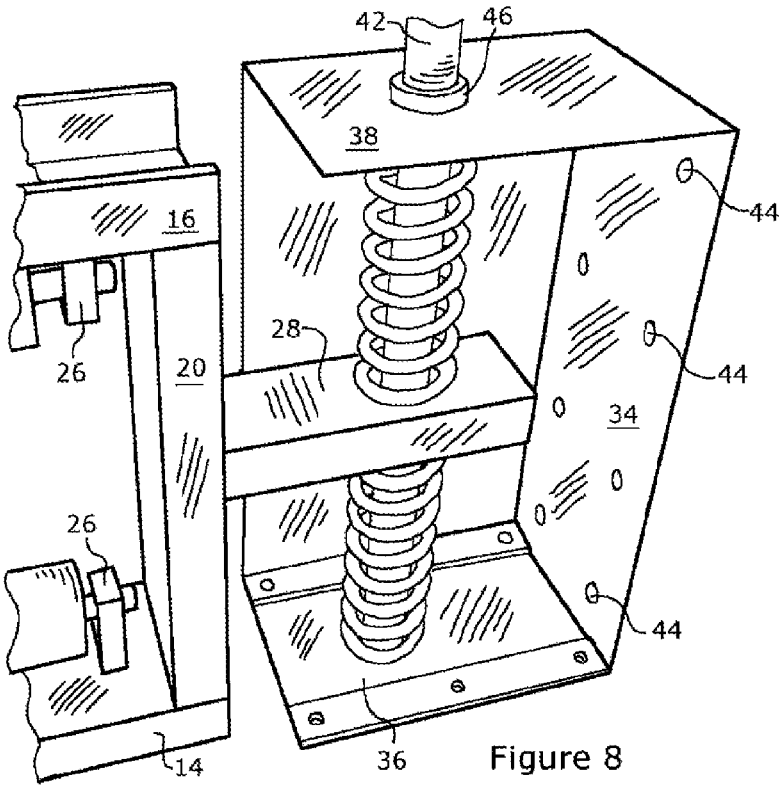
FIG. 8 is a perspective view from the bottom and front of the spring box subassembly and partial view of the left-most portion of the roller frame subassembly of the impact-reduction assembly according to the first embodiment with the front spring box side removed.
Figure 9:
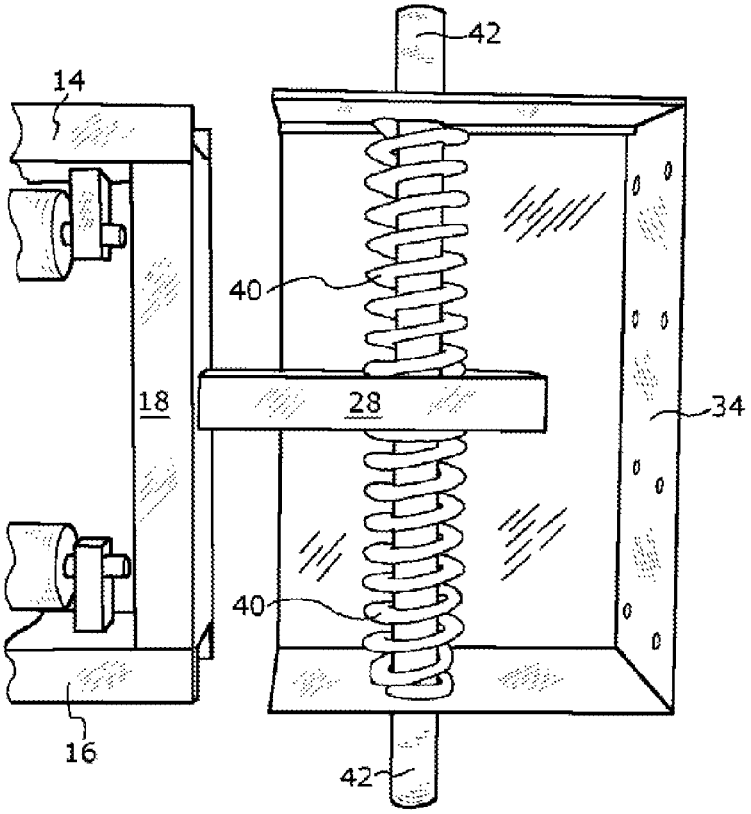
FIG. 9 is a front side, perspective, elevation view of the spring box subassembly and partial view of the right-most portion of the roller frame subassembly of the impact-reduction assembly according to the first embodiment with the front spring box side removed.
Figure 10:
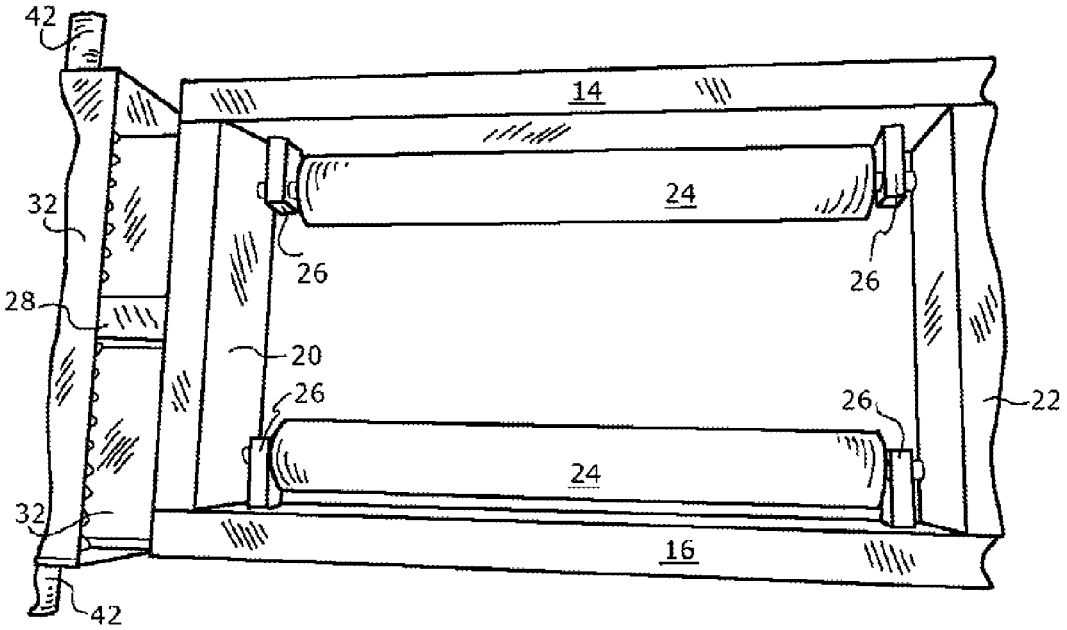
FIG. 10 is a partial, front side, perspective, elevation view of the left-most portion of the roller frame subassembly of the impact-reduction assembly according to the first embodiment.
Figure 11:
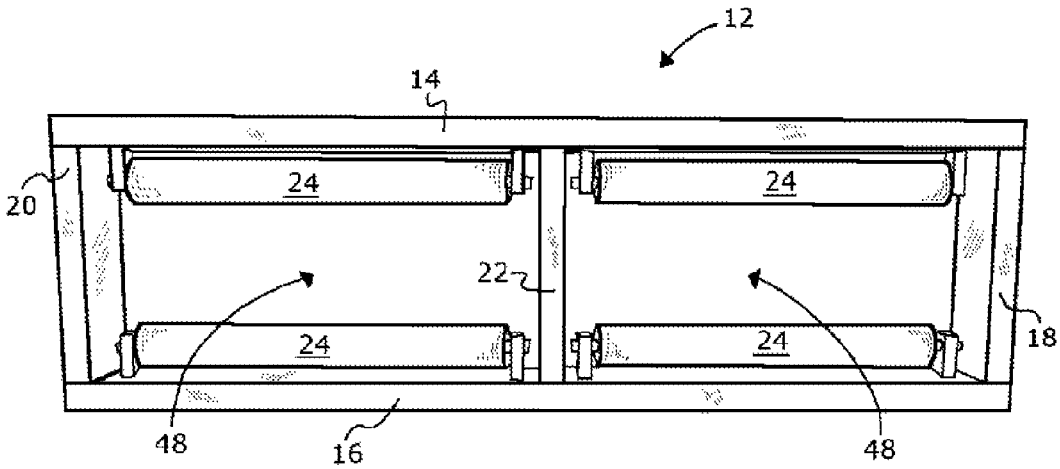
FIG. 11 is a front side, perspective, elevation view of the roller frame subassembly of the impact-reduction assembly according to the first embodiment.
Figure 12:
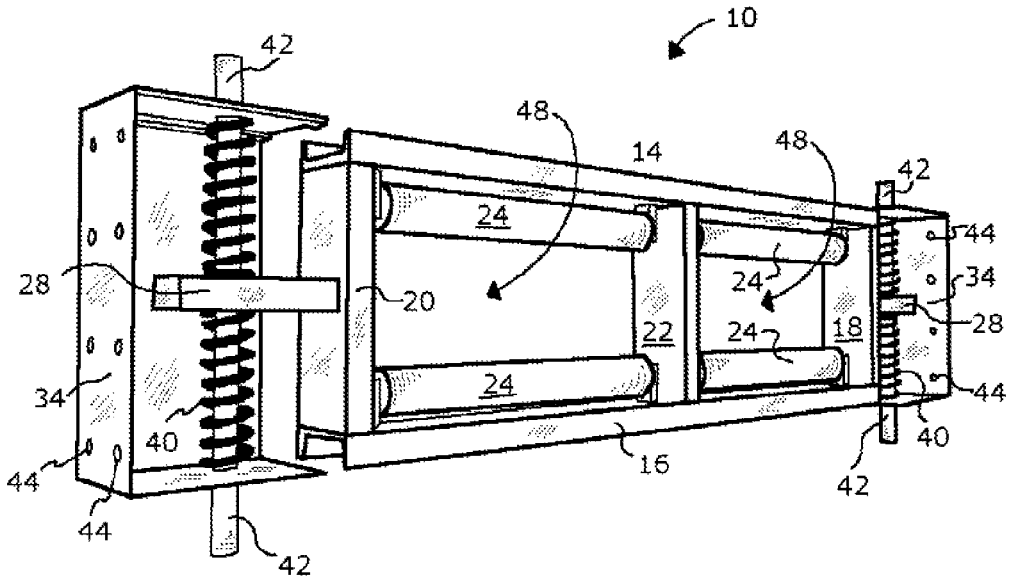
FIG. 12 is a front and left side perspective view of the impact-reduction assembly according to the first embodiment with the front spring box sides removed.
Figure 13:
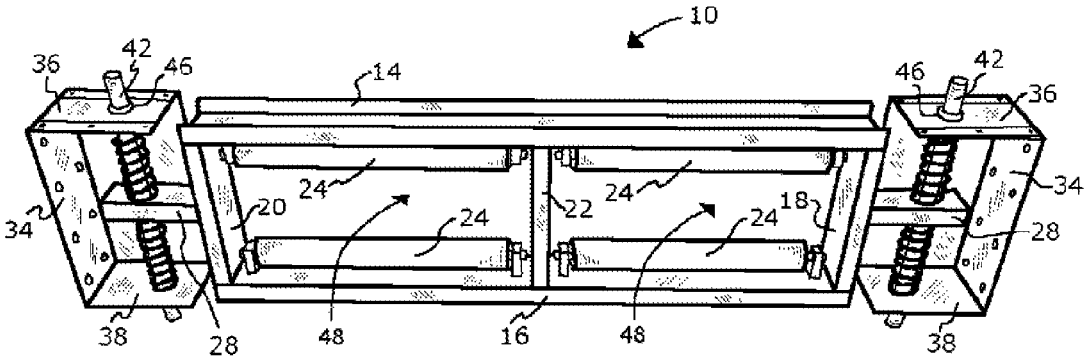
FIG. 13 is a front and top side, perspective view of the impact-reduction assembly according to the first embodiment with the front spring box sides removed.
Figure 14:
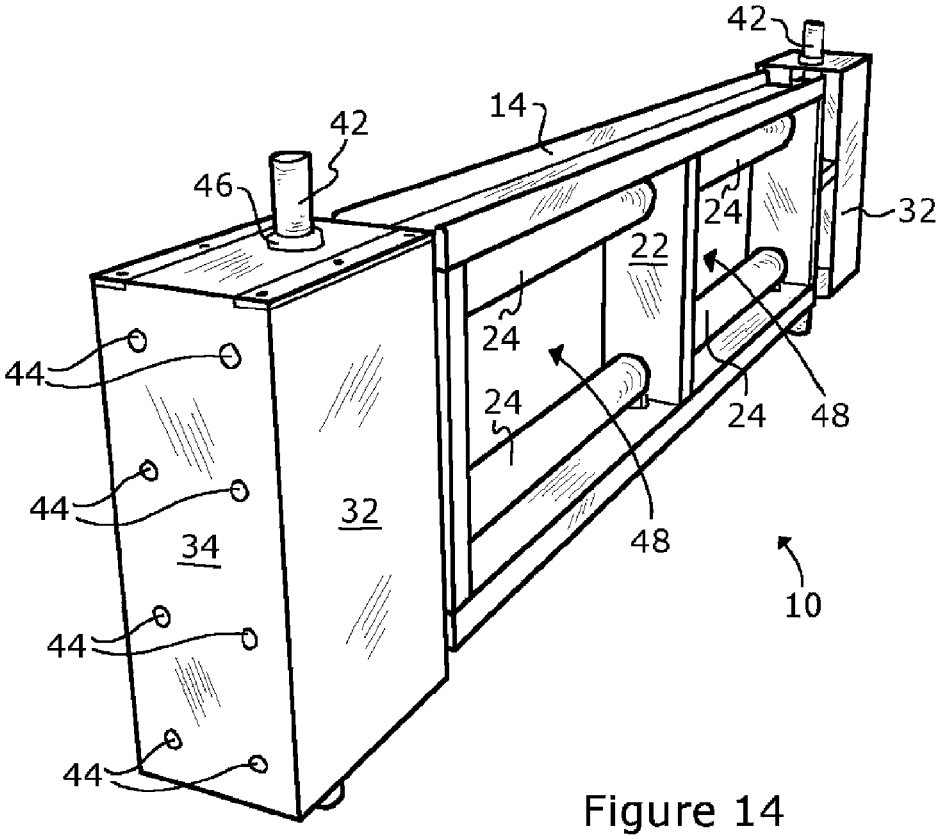
FIG. 14 is a front and left side perspective view of the impact-reduction assembly according to the first embodiment.
Figure 15:
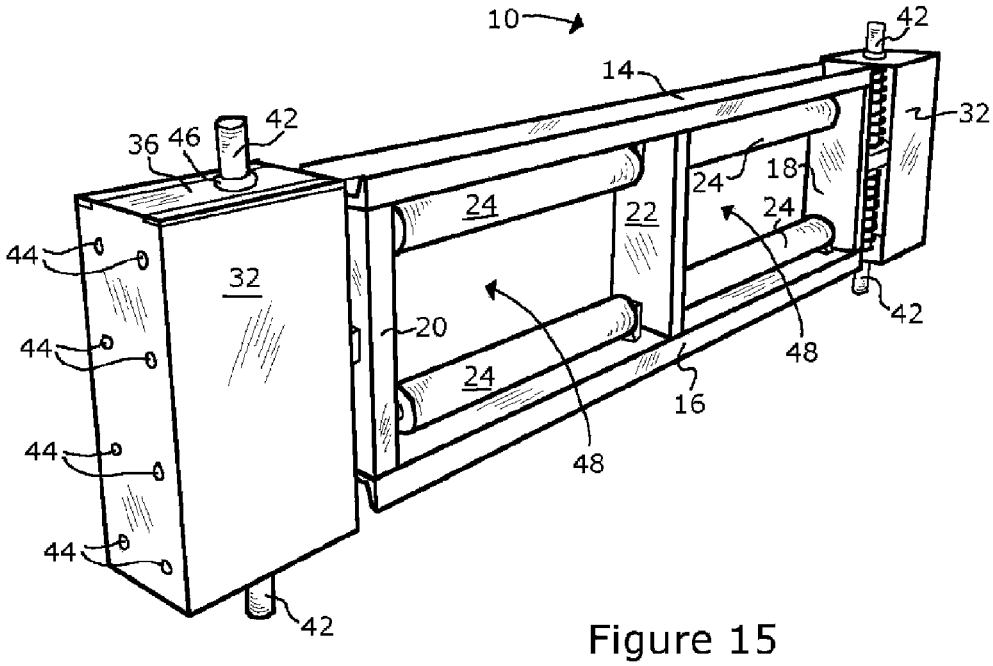
FIG. 15 is a front and left side perspective view of the impact-reduction assembly according to the first embodiment.
Figure 16:
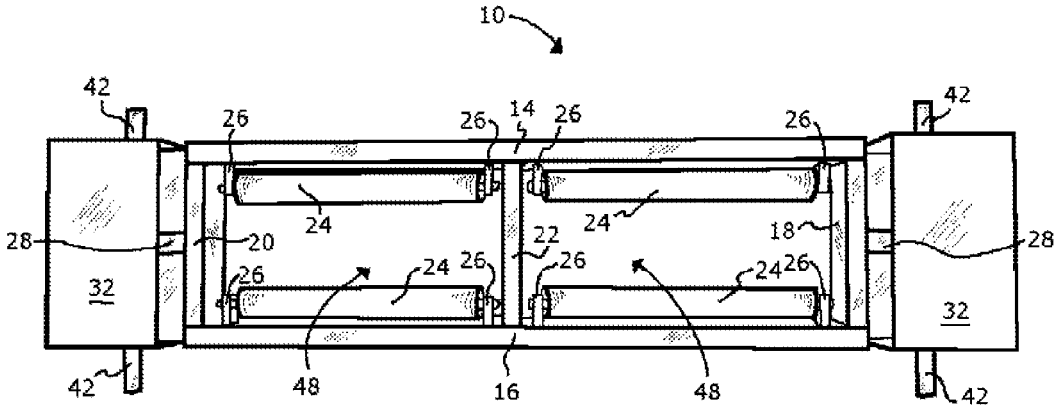
FIG. 16 is a front side, perspective, elevation view of the impact-reduction assembly according to the first embodiment.
Figure 17:
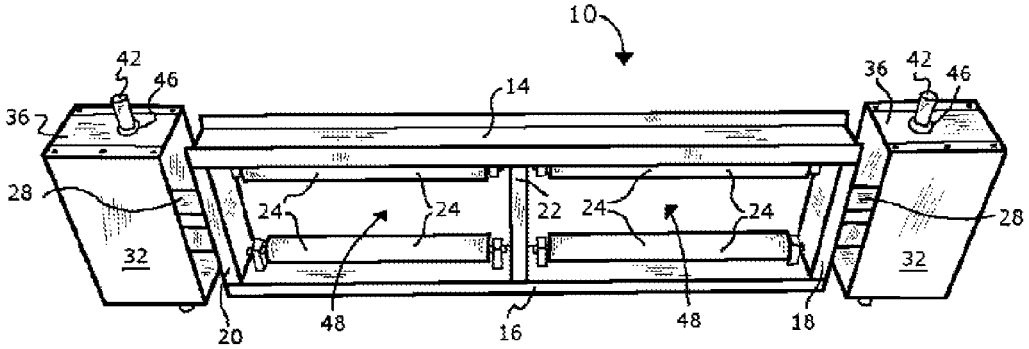
FIG. 17 is a front and top side, perspective view of the impact-reduction assembly according to the first embodiment.
Figure 18:
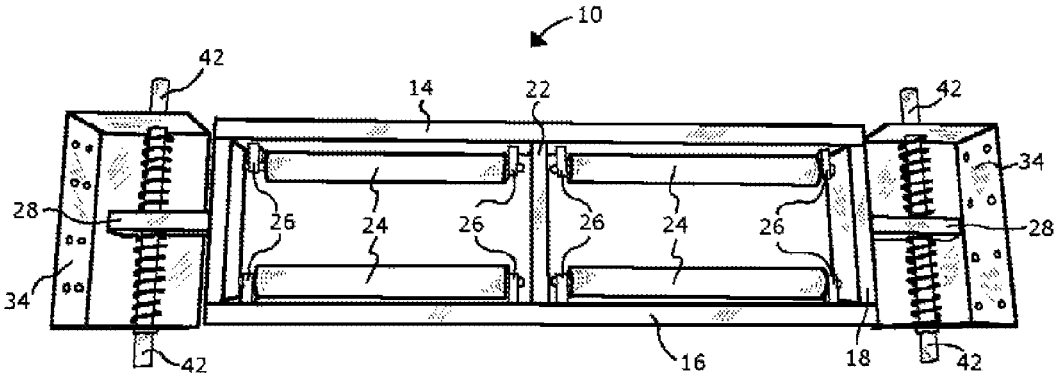
FIG. 18 is a front side, perspective view of the impact-reduction assembly according to the first embodiment with the front spring box sides removed.
Figure 19:
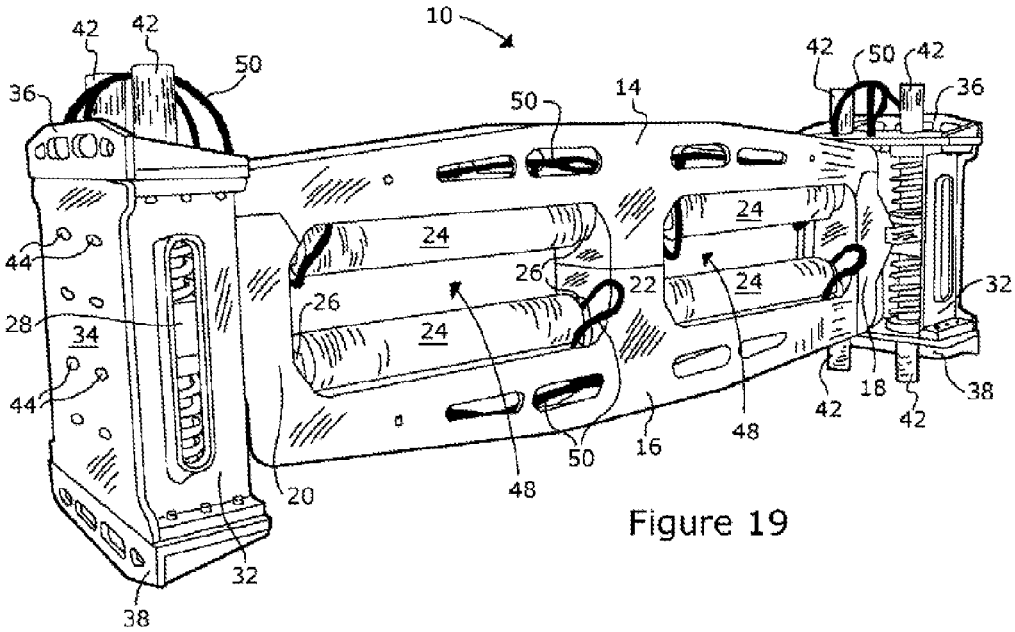
FIG. 19 is a front and left side, perspective view of an impact-reduction assembly according to a second embodiment.
Figure 20:
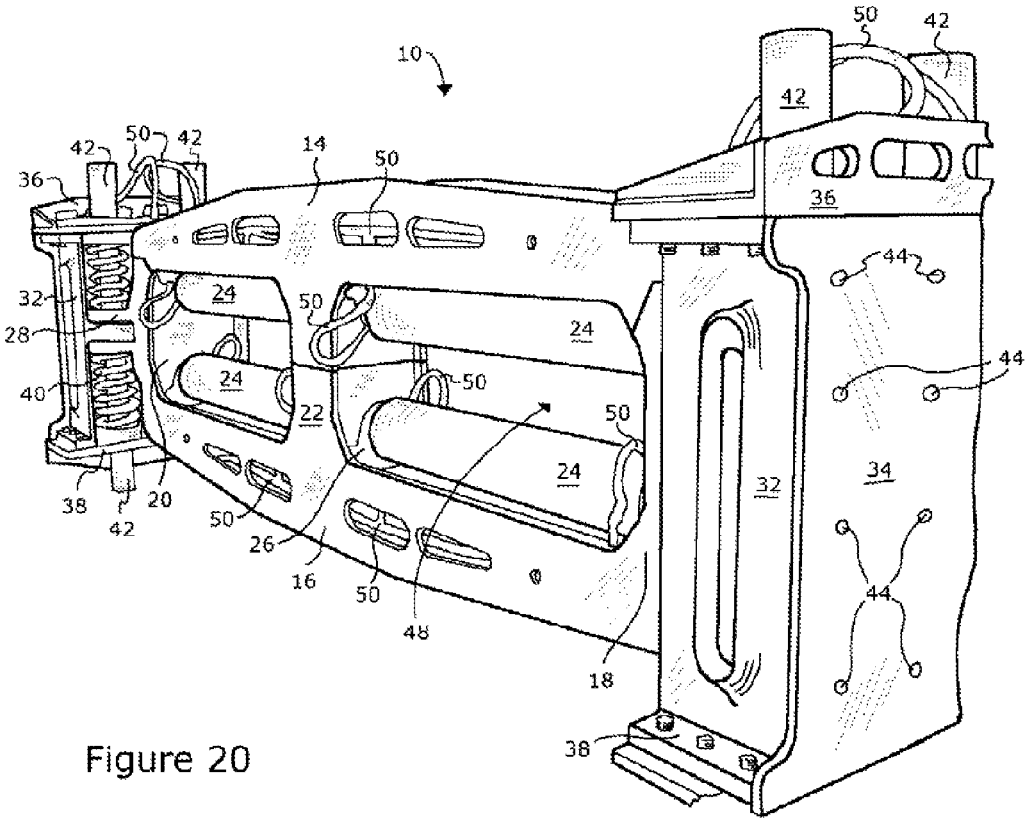
FIG. 20 is a front and right side, perspective view of the impact-reduction assembly according to the second embodiment.
Figure 21:
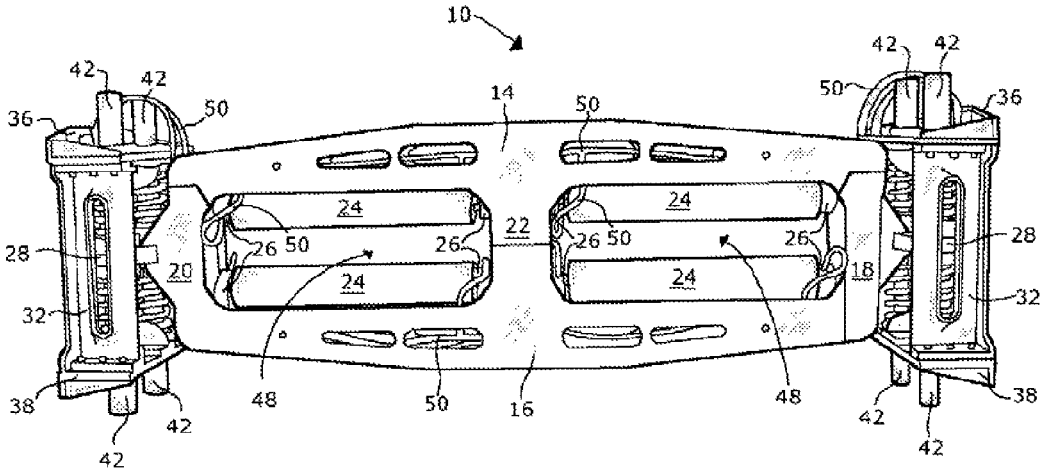
FIG. 21 is a front side, perspective view of the impact-reduction assembly according to the second embodiment.
Figure 22:
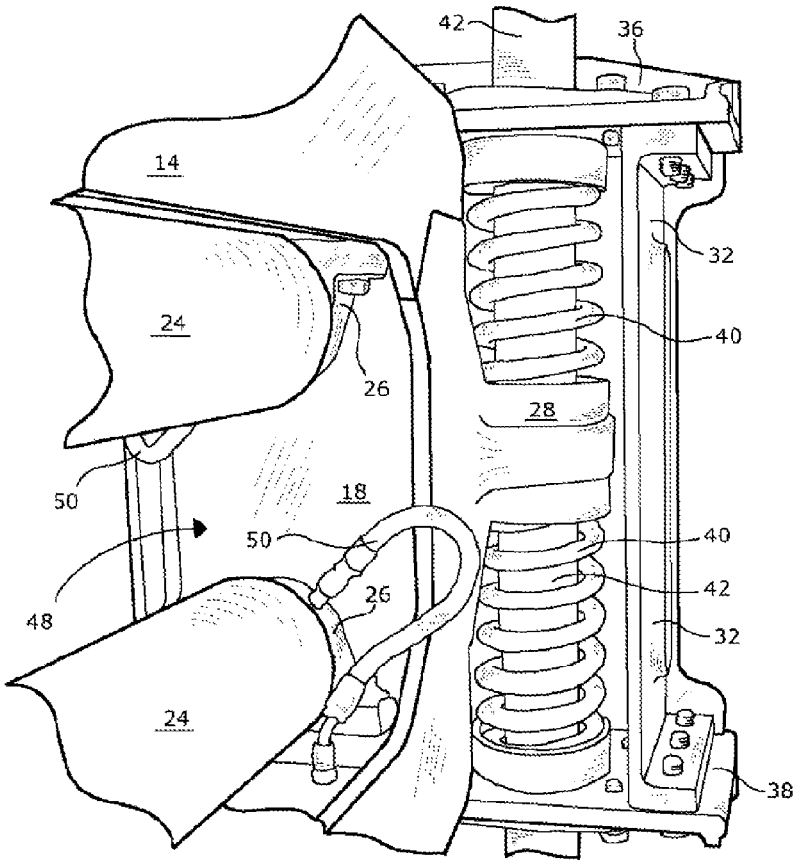
FIG. 22 is a front and left side, partial, perspective view of the right-most portion of the roller frame subassembly and right-most spring box subassembly of the impact-reduction assembly according to the second embodiment.

Each of the spring box subassemblies 30 include a pair of spring box sides 32, a spring box mounting side 34, a spring box bottom 38, and a spring retainer plate 36. Thus, each spring box subassembly 30 is practically a box that is missing one side. However, the shape of the spring box subassembly 30 may be varied, such as that shown in FIG. 24. Preferably, the spring box mounting side 34 is essentially perpendicular to the spring box sides 32, the spring box sides 32 are essentially parallel to one another, the spring retainer plate 36 is essentially perpendicular to both the spring box sides 32 and the spring box mounting side 34, and the spring box bottom 38 is essentially perpendicular to the spring box sides 32 and the spring box mounting side 34 and is essentially parallel to the spring retainer plate 36. It is preferred that the spring box sides 32 are made of half-inch-thick steel. In some embodiments, the spring box mounting side 34, spring retainer plate 36, and spring box bottom 38 are also made of half-inch-thick steel. According to the first preferred embodiment, the spring retainer plate 36 and spring box bottom 38 are essentially flat (FIG. 4). According to the second preferred embodiment, the spring retainer plate 36 and spring box bottom 38 are not entirely essentially flat (FIG. 24).

In some embodiments, such as the depicted second preferred embodiment, a bearing and seal retainer plate 37 is included and mounted to the spring retainer plate 36, as shown in FIGS. 23 and 24. More than one bearing and seal retainer plate 37 may be used, as in the third preferred embodiment shown in FIGS. 28 and 29.

According to the depicted embodiments, the spring box mounting side 34 of the spring box subassembly 30 further defines a plurality of side mounting points 44 that are designed to accommodate securing the spring box mounting side 34 to the machine. According to the depicted embodiments, the side mounting points 44 are side mounting holes configured for receiving therein screws or other mounting hardware. It is preferred that the spring box mounting sides 34 be each mounted to one of the two gantry legs of a mining shovel machine. In other embodiments, the spring box mounting sides are mounted to the housing of the machine. In addition, the spring retainer plate 36 defines a plurality of retainer plate mounting points 45 that are likewise designed to accommodate securing the spring retainer plate 36 to the machine or to the spring box mounting side 34 and spring box sides 32. In the second and third preferred embodiments, the bearing and seal retainer plates 37 likewise define retainer plate mounting points 45 that are designed to accommodate securing the bearing and seal retainer plates 37 to the spring retainer plate 36. According to all three of the depicted preferred embodiments, the mounting points 44, 45 are holes approximately one inch in diameter.

The spring retainer plate 36 and spring box bottom 38 also define rod insertion holes that are essentially aligned with one another. According to the first embodiment, into each rod insertion hole is placed a journal bearing 46, and through each journal bearing 46 is inserted one of the spring support rods 42. According to the second and third embodiments, the bearing and seal retainer plates 37 also define rod insertion holes that are essentially aligned with the rod insertion holes of the spring retainer plate 36. As such, the spring support rods 42 are inserted into the rod insertion holes of both the spring retainer plate 36 and the bearing and seal retainer plate or plates 37. In the second and third embodiments, journal bearings 46 and/or seals may be included and secured by the bearing and seal retainer plate or plates 37.

Preferably, each spring support rod 42 is welded to a roller frame support block 28. As such, the impact-reduction assembly 10 is configured so that each spring support rod 42 may move relative to the spring retainer plate 36 and the spring box bottom 38 but may not move relative to the roller frame support block 28 to which it is welded. In other embodiments in which the roller frame support block 28 also defines a rod insertion hole into which a spring support rod 42 is inserted, the roller frame support block 28 may move relative to the spring support rod 42. In configurations of these other embodiments, each spring support rod 42 is preferably fixedly attached to a spring retainer plate 36 or spring box bottom 38 such that the spring support rod 42 may not move relative to the spring retainer plate 36 and/or spring box bottom 38 to which it is fixedly attached while the spring support rod 42 may move relative to the roller frame support block 28.

It is further preferred that the spring retainer plate 36 be removable from the spring box sides 32 and the spring box mounting side 34 so that the inner workings of the spring box subassembly 30 may be accessed for maintenance or other purposes. According to the first, second, and third embodiments, each spring retainer plate 36 may be removed from the spring box subassembly 30 via releasing the spring retainer plate 36 at the retainer plate mounting points 45. In this way, the inner workings of the spring box subassembly 30 are accessible without complete disassembly of either the spring box subassemblies 30 or the impact-reduction assembly 10, itself.

Each spring box subassembly 30 further includes a number of springs 40 or other elastically compressible mechanisms, such as a pneumatic mechanism or hydraulic mechanism. According to the depicted embodiments, the elastically compressible mechanisms comprise pairs of coil springs 40. Each of the coil springs 40 are wound around a spring support rod 42, with the two coil springs 40 of the pair being separated from one another on the spring support rod 42 by the roller frame support block 28.

According to the preferred embodiments shown in FIGS. 1 through 29, when the impact-reduction box is mounted on the machine by mounting the spring box mounting side 34 to the machine, cables may be passed through the cable pass-through spaces 48. When these cables slap, whip, or otherwise move undesirably, they will contact the rollers 24. In doing so, the cables will apply a force to the rollers 24, which will necessarily apply a force to the roller frame subassembly 12. Accordingly, the roller frame support blocks 28 will feel the force and want to move in the direction of the cable impact. The roller frame support blocks 28 will act upon the respective springs 40 or other elastically compressible mechanism. The springs 40 will work together to resettle the roller frame support blocks 28 and, necessarily, also the roller frame subassembly 12. Thus, while the roller frame subassembly 12 will move in response to an impact from whipping or slapping cables, the spring box mounting side 34, spring box sides 32, spring retainer plate 36, and spring box bottom 38 will remain essentially motionless relative to the machine. Thus, the impact on the machine from undesirably moving cables will be greatly lessened if not eliminated. In addition, because the slapping cable will come into contact with the rounded rollers 24 rather than the edge of a housing window, the cable will be less likely to become worn due to the slapping and, therefore, less likely to break completely.

During installation of the first preferred embodiment of the impact-reduction assembly 10 (FIGS. 1 through 18), the spring box sides 32, spring box mounting sides 34, and spring box bottoms 38 are first attached to one another in the configuration described above. The spring box mounting sides 34 are then mounted to the gantry legs or housing of the mining shovel. One of each pair of springs 40 is then put in place on the spring box bottoms 38 in alignment with the journal bearings 46 and bottom rod insertion holes. The roller frame subassembly 12 is then put in place such that each spring support rod 42 passes through the already-in-place spring 40 and through the journal bearing 46 inserted in the spring box bottom 38. The second of each pair of springs 40 is then put in place on the already-in-place spring support rod 42. Finally, each spring retainer plate 36 is mounted to the respective spring box sides 32 and spring box mounting side 34. Thereafter, the hoisting cables or ropes are threaded through the cable pass-through spaces 48. To deliver maintenance to the spring box subassemblies 30, the spring retainer plates 36 may be removed so as to provide access to the inner parts of the spring box subassemblies 30.

The installation of the second and third preferred embodiment of the impact-reduction assembly 10 (FIGS. 19 through 29) is much the same, with the exception that either prior to or while installing the roller frame subassembly 12, the upper frame segment 52 and the lower frame segment 54 are interconnected. In this way, the upper frame middle support 22' and lower frame middle support 22" interconnect to form the equivalent of the frame middle support 22 of the first embodiment.

According to the second preferred embodiment, the impact-reduction assembly 10 further includes a lubrication system 50 configured to lubricate the rollers 24 during operation of the impact-reduction assembly 10. As shown, the lubrication system 50 is incorporated throughout the roller frame subassembly 12 so as to provide lubrication to the rollers 24 via the block bearings 26 connecting the rollers 24 to the frame top side 14 or frame bottom side 16, as the case may be. Preferably, each end of each roller 24 and, therefore, each block bearing attaching to the roller 24 ends, are provided with lubrication via the lubrication system 50.

While there is shown and described the present preferred embodiments of the impact-reduction box, it is to be distinctly understood that this invention is not limited thereto but may be variously embodied to practice within the scope of this disclosure. From the foregoing description, it will be apparent that various changes may be made without departing from the spirit and scope of the invention as defined by this disclosure. For example, while it is expected that the present impact-reduction box will be particularly useful for mounting on an electric mining shovel so as to reduce the impact on the machine from a hoisting rope unexpectedly or undesirably whipping and to reduce the wear and tear on the hoisting rope from slapping against the window opening in the housing of the mining shovel, the impact-reduction box is likely also useful for mounting on other machines to which cables, robes, chains, or other cable-like attachments are affixed. As such, the drawings and description of the preferred embodiments are to be regarded as illustrative in nature, and not as restrictive in nature.

What is claimed is:

1. An impact-reduction box for reducing the impact of cables on a machine when the cables move undesirably and for reducing wear and tear on the cables, the cables being connected to the machine, the impact-reduction box comprising:

a roller frame subassembly comprising:

a roller frame comprising a frame top side, a frame bottom side, a frame right side, and a frame left side, the frame top side being connected to the frame right side and the frame left side, the frame bottom side being connected to the frame right side and the frame left side;

a plurality of rollers, at least one roller of the plurality being attached to the frame top side and at least another roller of the plurality being attached to the frame bottom side;

a plurality of roller frame support blocks, at least one roller frame support block of the plurality being fixedly attached to the frame right side and at least another roller frame support block of the plurality being fixedly attached to the frame left side; and a pair of spring support rods, each spring support rod of the pair of spring support rods being attached to one roller frame support block of the plurality;

the roller frame subassembly defining at least one cable pass-through space between at least two rollers of the plurality, each cable pass-through space configured to accommodate passage therethrough of the cable;

a plurality of spring box subassemblies, each spring box subassembly of the plurality comprising:

a pair of spring box sides;

a spring box mounting side attached to each spring box side of the pair of spring box sides, the spring box mounting side being configured to accommodate securing of the spring box mounting side to the machine;

a spring box bottom connected to the pair of spring box sides and to the spring box mounting side, the spring box bottom defining a bottom rod insertion hole;

a spring retainer plate connected to the pair of spring box sides and to the spring box mounting side, the spring retainer plate including a plurality of retainer plate mounting points, each retainer plate mounting point of the plurality being configured to accommodate securing of the spring retainer plate to the machine, to the pair of spring box sides, or to the spring box mounting side, the spring retainer plate defining a top rod insertion hole;

a plurality of springs, each spring of the plurality winding around one or the other spring support rod of the pair of spring support rods, at least one of the plurality of springs being wound around a top portion of the one spring support rod and at least another of the plurality of springs being wound around a bottom portion of the one spring support rod;

wherein, when the impact-reduction box is mounted on the machine and the cable passes through the at least one cable pass-through space, when the cable moves undesirably, the cable will impact one of the rollers of the plurality and, therefore, assert a force on the roller such that the force will be asserted on the roller frame subassembly, the roller frame subassembly will thereafter move in response to the force and move relative to each spring box subassembly of the plurality, such that the plurality of roller frame support blocks will move against the plurality of springs, in which case, the plurality of springs will react to the plurality of roller frame support blocks to stabilize the roller frame subassembly, such that the cable's impact on the plurality of rollers will not be fully felt by the machine.

2. The impact-reduction box of claim 1, wherein the roller frame subassembly further comprises a frame middle support attached to the frame top side and to the frame bottom side and positioned between the frame right side and the frame left side.

3. The impact-reduction box of claim 1, wherein the spring box mounting side comprises side mounting holes.

4. The impact-reduction box of claim 1, wherein the pair of spring support rods is approximately two inches in diameter.

5. The impact-reduction box of claim 1, wherein the plurality of retainer plate mounting points comprises retainer plate mounting holes.

6. The impact-reduction box of claim 1, wherein the spring retainer plate is configured to be removable from the plurality of spring box subassemblies so as to accommodate maintenance of the plurality of spring box subassemblies.

7. The impact-reduction box of claim 1, wherein the pair of spring box sides is made of half-inch-thick steel.

8. The impact-reduction box of claim 1, wherein the pair of spring support rods is made of roll steel with approximately two-inch diameters.

9. The impact-reduction box of claim 1, wherein the plurality of roller frame support blocks is configured to move relative to the pair of spring support rods, and wherein the pair of spring support rods is configured to not move relative to the spring retainer plate and the spring box bottom, such that when the cable passing through the at least one cable pass-through space whips, slaps, or moves undesirably and impacts one of the rollers, the roller frame subassembly will move relative to the machine in response to the cable's impact while the pair of spring support rods will not move in response to the cable's impact.

10. The impact-reduction box of claim 1, wherein the plurality of roller frame support blocks is configured to not move relative to the pair of spring support rods, and wherein the pair of spring support rods is configured to move relative to the spring retainer plate and the spring box bottom, such that when the cable passing through the at least one cable pass-through space whips, slaps, or moves undesirably and impacts one of the rollers, the roller frame subassembly and the pair of spring support rods will move relative to the machine in response to the cable's impact while the spring retainer plate and the spring box bottom will not move in response to the cable's impact.

11. The impact-reduction box of claim 10, wherein each roller frame support block of the plurality is welded to one of the pair of spring support rods.

12. The impact-reduction box of claim 1, wherein the plurality of rollers are nylon rollers having diameters in the range of three to four inches.

13. The impact-reduction box of claim 1, wherein at least one roller frame support block of the plurality is welded to the frame right side and at least another roller frame support block of the plurality is welded to the frame left side.

14. The impact-reduction box of claim 1, wherein the frame left side and the frame right side are made of two-by-ten box tubing.

15. The impact-reduction box of claim 1, wherein the frame top side and the frame bottom side are made of one-and-a-half-by-ten channel iron.

16. An impact-reduction box for reducing the impact of cables on a machine when the cables swing undesirably, the cables being connected to the machine, the impact-reduction box comprising:

a roller frame subassembly comprising:

a roller frame comprising a frame top side, a frame bottom side, a frame right side, and a frame left side, the frame top side being connected to the frame right side and the frame left side, the frame bottom side being connected to the frame right side and the frame left side;

a plurality of rollers, at least one roller of the plurality being fixedly attached to the frame top side via a pair of pillow block bearings and at least another roller of the plurality being fixedly attached to the frame bottom side via another pair of pillow block bearings;

a plurality of roller frame support blocks, at least one roller frame support block of the plurality being fixedly attached to the frame right side and at least another roller frame support block of the plurality being fixedly attached to the frame left side; and a plurality of spring support rods, each spring support rod of the plurality being attached to one of the roller frame support blocks of the plurality at a middle portion of the spring support rod;

the roller frame subassembly defining at least one cable pass-through space between at least two rollers of the plurality, each of the at least one cable pass-through spaces configured to accommodate passage therethrough of the cable;

a plurality of spring box subassemblies, each spring box subassembly of the plurality comprising:

a pair of spring box sides;

a spring box mounting side attached to each spring box side, the spring box mounting side defining a plurality of side mounting points configured to accommodate securing of the spring box mounting side to the machine;

a spring box bottom connected to the pair of spring box sides and to the spring box mounting side, the spring box bottom defining a bottom rod insertion hole;

a spring retainer plate connected to the pair of spring box sides and to the spring box mounting side, the spring retainer plate defining a plurality of retainer plate mounting points, each retainer plate mounting point of the plurality being configured to accommodate securing of the spring retainer plate to the machine, to the pair of spring box sides, or to the spring box mounting sides, the spring retainer plate defining a top rod insertion hole;

a plurality of springs, each spring of the plurality winding around a spring support rod of the plurality of spring support rods, one spring of the plurality being wound around a top portion of one spring support rod of the plurality and another spring of the plurality being wound around a bottom portion of the one spring support rod of the plurality;

wherein, when the impact-reduction box is mounted on the machine and the cable passes through the at least one cable pass-through space, when the cable moves undesirably, the cable will impact one of the rollers of the plurality and, therefore, assert a force on the roller such that the force will be asserted on the roller frame subassembly, the roller frame subassembly will thereafter move in response to the force and move relative to each spring box subassembly of the plurality, such that the plurality of roller frame support blocks will move against the plurality of springs, in which case, the plurality of springs will react to the plurality of roller frame support blocks to stabilize the roller frame subassembly, such that the cable's impact on the plurality of rollers will not be fully felt by the machine.

17. An impact-reduction box for reducing the impact of cables on a machine when the cables swing undesirably, the cables being connected to the machine, the impact-reduction box comprising:

a roller frame subassembly comprising:

an upper frame segment, the upper frame segment comprising a frame top side and an upper frame middle support, the frame top side being connected to the upper frame middle support;

a lower frame segment, the lower frame segment comprising:

a frame bottom side, a frame right side, a frame left side, and a lower frame middle support, the frame bottom side being connected to the frame right side, the frame left side, and the lower frame middle support;

the upper frame segment and the lower frame segment being configured to interconnect with one another;

a plurality of rollers, one roller of the plurality being fixedly attached to the frame top side and another roller of the plurality being fixedly attached to the frame bottom side; and a plurality of roller frame support blocks, at least one roller frame support block of the plurality being fixedly attached to the frame right side and at least another roller frame support block of the plurality being fixedly attached to the frame left side; and a plurality of spring support rods, each spring support rod of the plurality being fixedly attached to one roller frame support block of the plurality;

the frame left side, the frame top side, the upper frame middle support, the lower frame middle support, and the frame bottom side defining a left cable pass-through space between at least two rollers of the plurality, the left cable pass-through space configured to accommodate passage therethrough of the cable;

the frame right side, the frame top side, the upper frame middle support, the lower frame middle support, and the frame bottom side defining a right cable pass-through space between another at least two rollers of the plurality, the right cable pass-through space configured to accommodate passage therethrough of the cable;

at least two spring box subassemblies, each spring box subassembly of the at least two spring box subassemblies comprising:

a pair of spring box sides;

a spring box mounting side attached to each spring box side of the pair of spring box sides, the spring box mounting side defining a plurality of side mounting points configured to accommodate securing of the spring box mounting side to the machine;

a spring box bottom connected to the pair of spring box sides and to the spring box mounting side, the spring box bottom defining a bottom rod insertion hole;

a spring retainer plate connected to the pair of spring box sides and to the spring box mounting side, the spring retainer plate defining a plurality of retainer plate mounting points, the plurality of retainer plate mounting points being configured to accommodate securing of the spring retainer plate to the machine, to the pair of spring box sides, or to the spring box mounting side, the spring retainer plate defining a top rod insertion hole; and a plurality of springs, each spring of the plurality winding around a spring support rod of the plurality, one spring of the plurality being wound around a top portion of one spring support rod of the plurality, and another spring of the plurality being wound around a bottom portion of the one spring support rod of the plurality;

wherein, when the impact-reduction box is mounted on the machine and the cable passes through the left cable pass-through space and the right cable pass-through space, when the cable whips undesirably, the cable will impact one of the rollers of the plurality and, therefore, assert a force on the roller such that the force will be asserted on the roller frame subassembly, the roller frame subassembly will thereafter move in response to the force and move relative to each spring box subassembly of the at least two spring box subassemblies, such that the plurality of roller frame support blocks will move against the plurality of springs, in which case, the plurality of springs will react to the plurality of roller frame support blocks to stabilize the roller frame subassembly, such that the cable's impact on the plurality of rollers will not be fully felt by the machine.

18. The impact-reduction box of claim 17, further comprising:

a plurality of block bearings, each block bearing of the plurality supporting at least one roller of the plurality; and a lubrication system, the lubrication system being configured to lubricate the plurality of rollers.

* * * * *